US010231561B2

(12) United States Patent
Lin

(10) Patent No.: US 10,231,561 B2
(45) Date of Patent: Mar. 19, 2019

(54) STORAGE BUCKET

(71) Applicant: Actigift Development Co., Ltd., Kaohsiung (TW)

(72) Inventor: Victor Lin, Kaohsiung (TW)

(73) Assignee: Actigift Development Co., Ltd., Kaohsiung (TW)

( * ) Notice: Subject to any disclaimer, the term of this patent is extended or adjusted under 35 U.S.C. 154(b) by 0 days.

(21) Appl. No.: 15/942,723

(22) Filed: Apr. 2, 2018

(65) Prior Publication Data

US 2018/0289193 A1 Oct. 11, 2018

(30) Foreign Application Priority Data

Apr. 7, 2017 (CN) ..... 2017 2 0358074

(51) Int. Cl.

| | |
|---|---|
| ***A47G 29/00*** | (2006.01) |
| ***A47G 29/093*** | (2006.01) |
| ***A47G 23/02*** | (2006.01) |
| ***F25D 3/08*** | (2006.01) |
| *F25D 31/00* | (2006.01) |

(52) U.S. Cl.

CPC ..... *A47G 29/093* (2013.01); *A47G 23/0241* (2013.01); *F25D 3/08* (2013.01); *A47G 23/0225* (2013.01); *A47G 2023/0275* (2013.01); *F25D 31/007* (2013.01); *F25D 2303/081* (2013.01); *F25D 2331/803* (2013.01); *F25D 2331/809* (2013.01)

(58) Field of Classification Search

CPC ..... A47G 29/093; A47G 23/0241; A47G 23/0225; A47G 2023/0275; F25D 3/08; F25D 31/007; F25D 2304/081; F25D 2331/803; F25D 2331/809

USPC ..... 248/687, 311.2, 317, 324, 325; 220/735, 220/737, 694, 62.12; 224/926

See application file for complete search history.

(56) References Cited

U.S. PATENT DOCUMENTS

| | | | | |
|---|---|---|---|---|
| 6,308,379 | B1 * | 10/2001 | Hendrickson | A47J 45/065 220/669 |
| 2012/0193251 | A1 * | 8/2012 | Rittmann | B44D 3/121 206/229 |
| 2018/0215301 | A1 * | 8/2018 | Smithson | B60N 3/105 |

* cited by examiner

*Primary Examiner* — Todd M Epps

(74) *Attorney, Agent, or Firm* — C. G. Mersereau; DeWitt LLP

(57) ABSTRACT

A storage bucket has a storage member and a supporting assembly. The storage member has a body, a holding portion, and two slip-proof elements. The holding portion is formed on the outer surface of the body. The slip-proof elements are disposed on a bottom surface of the holding portion. The supporting assembly is rotatably disposed on the storage member and has a supporting rod, two shafts, and a slip-proof foot. The supporting rod is disposed on the body. The shafts are respectively and fixedly disposed on two sides of the supporting rod. The shafts are rotatably inserted into the body. The slip-proof foot is disposed on a top end of the supporting rod. The storage bucket can be located beside the edge of a table and occupies little space above the table-top surface. Retrieving objects from the storage bucket is convenient.

24 Claims, 15 Drawing Sheets

STORAGE BUCKET

This application claims the benefit of China patent application No. 201720358074.1, filed on Apr. 7, 2017, the entire contents of which are incorporated herein by reference.

BACKGROUND OF THE INVENTION

1. Field of the Invention

The present invention relates to a storage bucket, and more particularly to a storage bucket that can abut an edge of a table.

2. Description of Related Art

A conventional storage bucket is applied to store objects. Take wine bottle storage for example. The conventional storage bucket has a flat inner-bottom surface. Ice cubes can be stored in the conventional storage bucket for freezing the wine bottle put in the conventional storage bucket. The temperature of the wine in the wine bottle is decreased. Users drink the wine in the wine bottle and feel cool. The conventional storage bucket is usually put on a table for users to take the wine bottle in the conventional storage bucket easily.

However, the conventional storage bucket put on the table occupies quite a lot of space on the table. For increasing the available space on the table, the conventional storage bucket can be put on the ground instead. When the conventional storage bucket is put on the ground, users need to stoop to take the wine bottle from the conventional storage bucket. Furthermore, when put on the ground, the conventional storage bucket is not easily noticeable and is prone to be collided by users. In addition, the wine bottle is put in the conventional storage bucket randomly and then might be inclinedly located in the conventional storage bucket. The wine bottle cannot contact the ice cubes evenly and be frozen evenly by the ice cubes. The mouthfeel of the wine is negatively affected.

To overcome the shortcomings, the present invention tends to provide a storage bucket to mitigate or obviate the aforementioned problems.

SUMMARY OF THE INVENTION

The main objective of the invention is to provide a storage bucket that may solve the problems that the conventional storage bucket put on the table occupies too much space above the table-top surface, the conventional storage bucket put on the ground is easy to be collided, the wine bottle in the conventional storage bucket on the ground is hard to retrieve, and the storage bucket may further solve the problem that the wine bottle inclinedly located in the conventional storage bucket cannot be frozen evenly and the mouthfeel of the wine is negatively affected.

The storage bucket has a storage member and a supporting assembly. The storage member has a body, a holding portion, and two slip-proof elements. The body has a top surface, an outer surface, a chamber, and an opening. The chamber of the body is formed in the body. The opening of the body is formed on the top surface of the body and is in communication with the chamber of the body. The holding portion is formed on the outer surface of the body, is disposed adjacent to the opening of the body, and has a bottom surface. The slip-proof elements are disposed on the bottom surface of the holding portion at a spaced interval.

The supporting assembly is pivotally disposed on the storage member and has a supporting rod, two shafts, and a slip-proof foot. The supporting rod is disposed on the body and has two sides and a top end. The shafts are respectively and fixedly disposed on the two sides of the supporting rod. The shafts are rotatably inserted into the body. The slip-proof foot is disposed on the top end of the supporting rod.

Furthermore, the body has a protrusion. The protrusion is formed on an inner bottom surface of the body and is inserted into the chamber of the body. When a wine bottle is put in the storage bucket, the protrusion can be inserted into a recess formed on a bottom surface of the wine bottle, and then the wine bottle stands uprightly in the storage bucket.

In use, the storage bucket can abut an edge of a table by the two slip-proof elements of the body and the slip-proof foot of the supporting rod. When the storage bucket is located beside the edge of the table, the storage bucket does not occupy a space above the table-top surface, and taking the objects from the storage bucket is convenient. Furthermore, multiple storage buckets can be stacked upwardly to save a storage space. In addition, when the wine bottle is put in the storage bucket, the protrusion of the body can be inserted into the recess of the wine bottle, and the wine bottle stands uprightly to be cooled evenly for improving the mouthfeel of the wine in the wine bottle.

Other objects, advantages and novel features of the invention will become more apparent from the following detailed description when taken in conjunction with the accompanying drawings.

DETAILED DESCRIPTION OF PREFERRED EMBODIMENT

Figure 1:
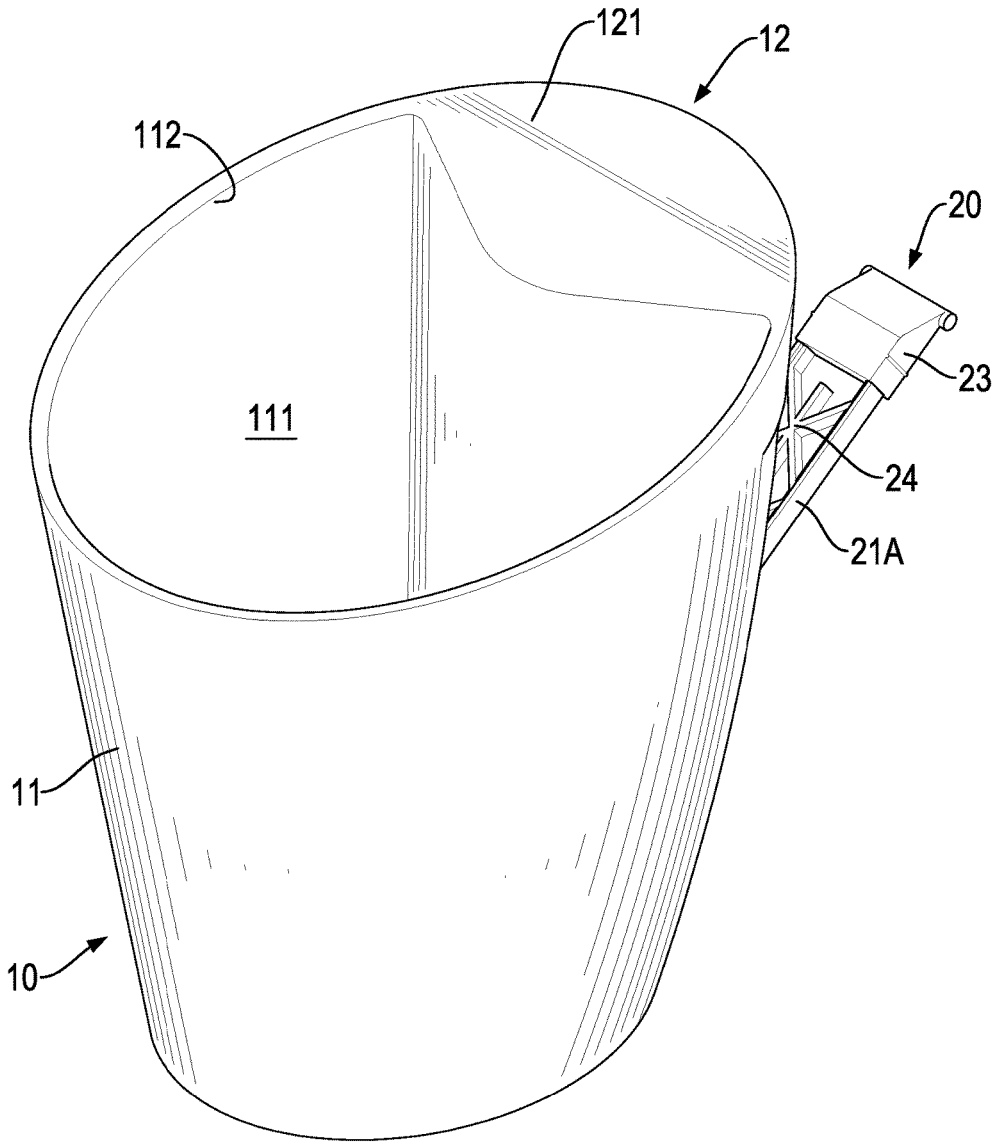
FIG. 1 is a perspective view of a first embodiment of a storage bucket in accordance with the present invention.
Figure 2:
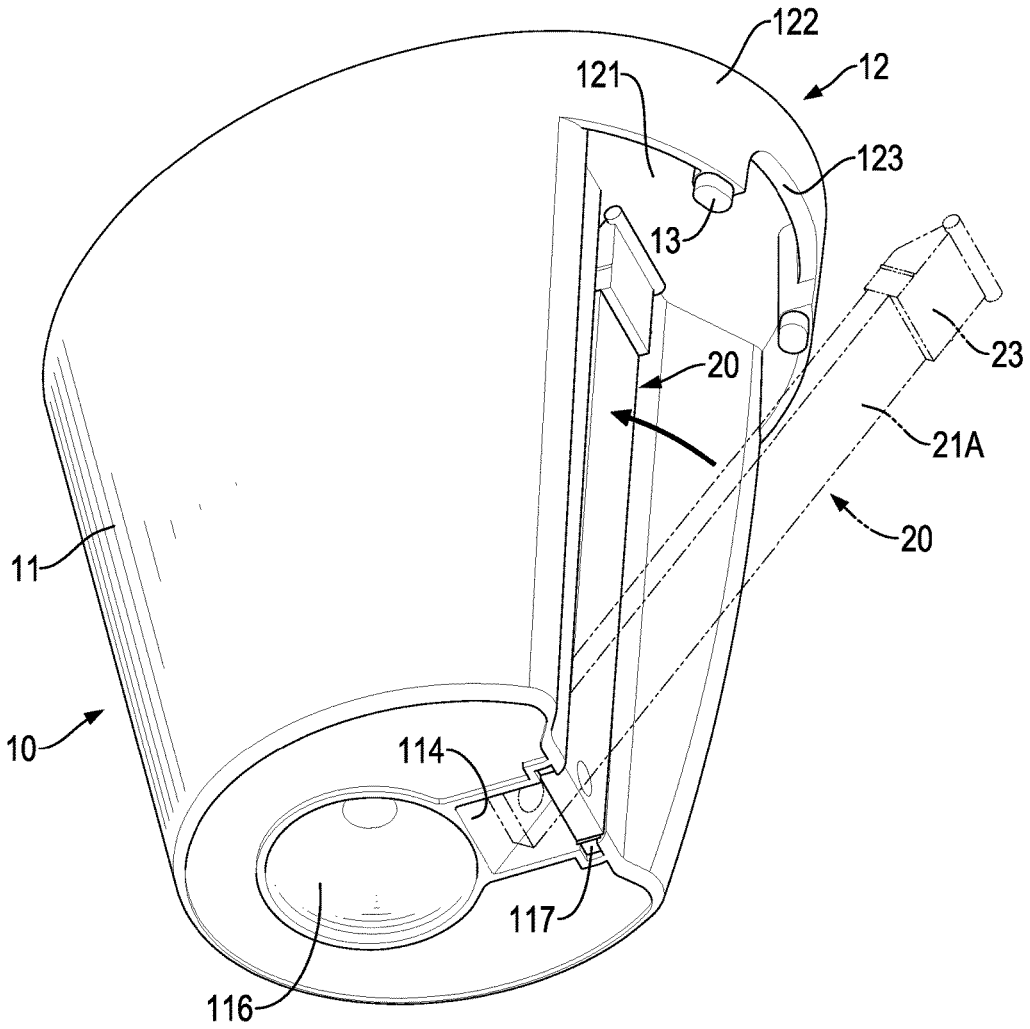
FIG. 2 is another perspective view of the storage bucket in FIG. 1.
Figure 3:
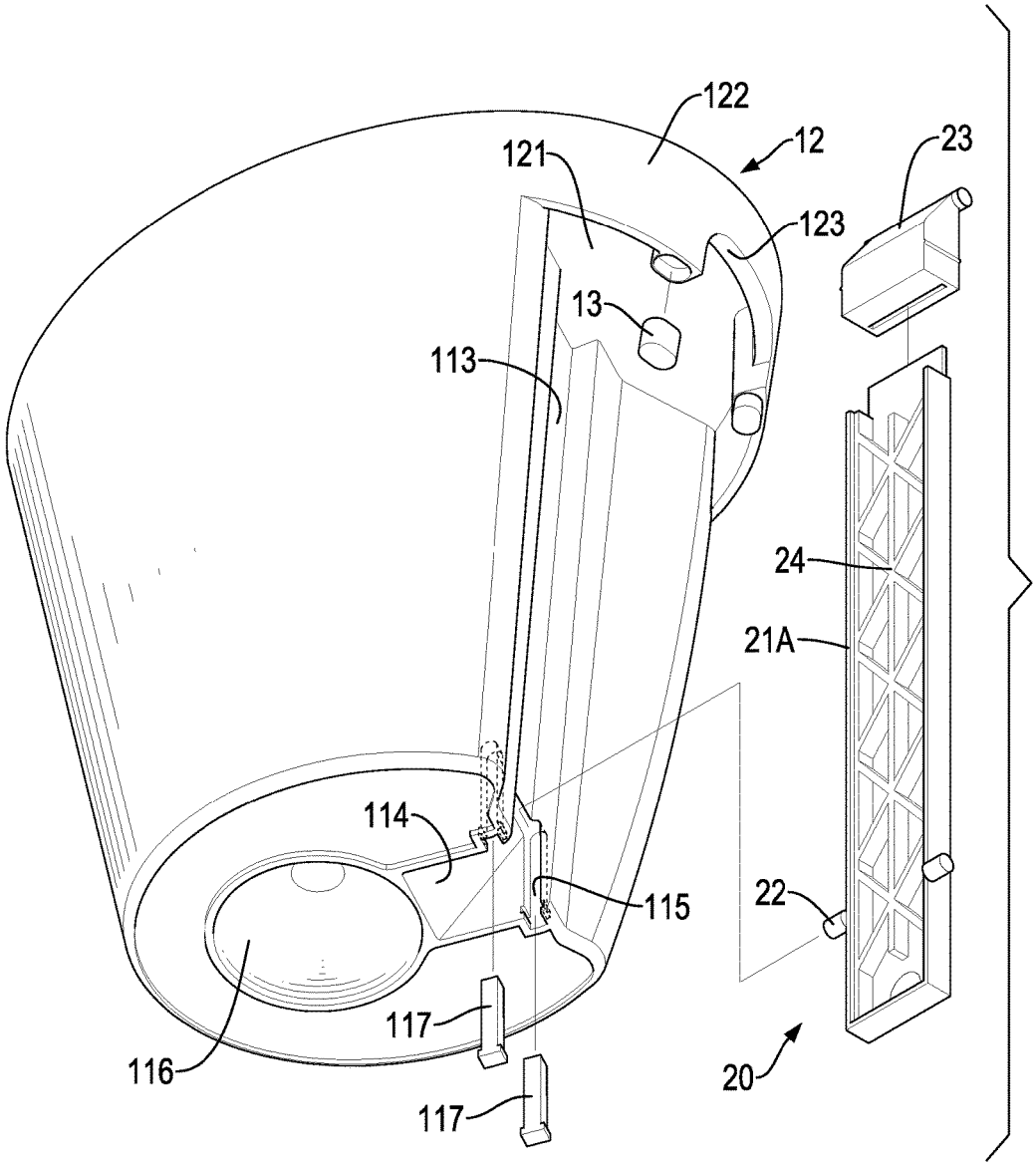
FIG. 3 is an exploded perspective view of the storage bucket in FIG. 2.

With reference to FIGS. 1 to 3, a first embodiment of a storage bucket in accordance with the present invention comprises a storage member 10 and a supporting assembly 20.

Figure 10:
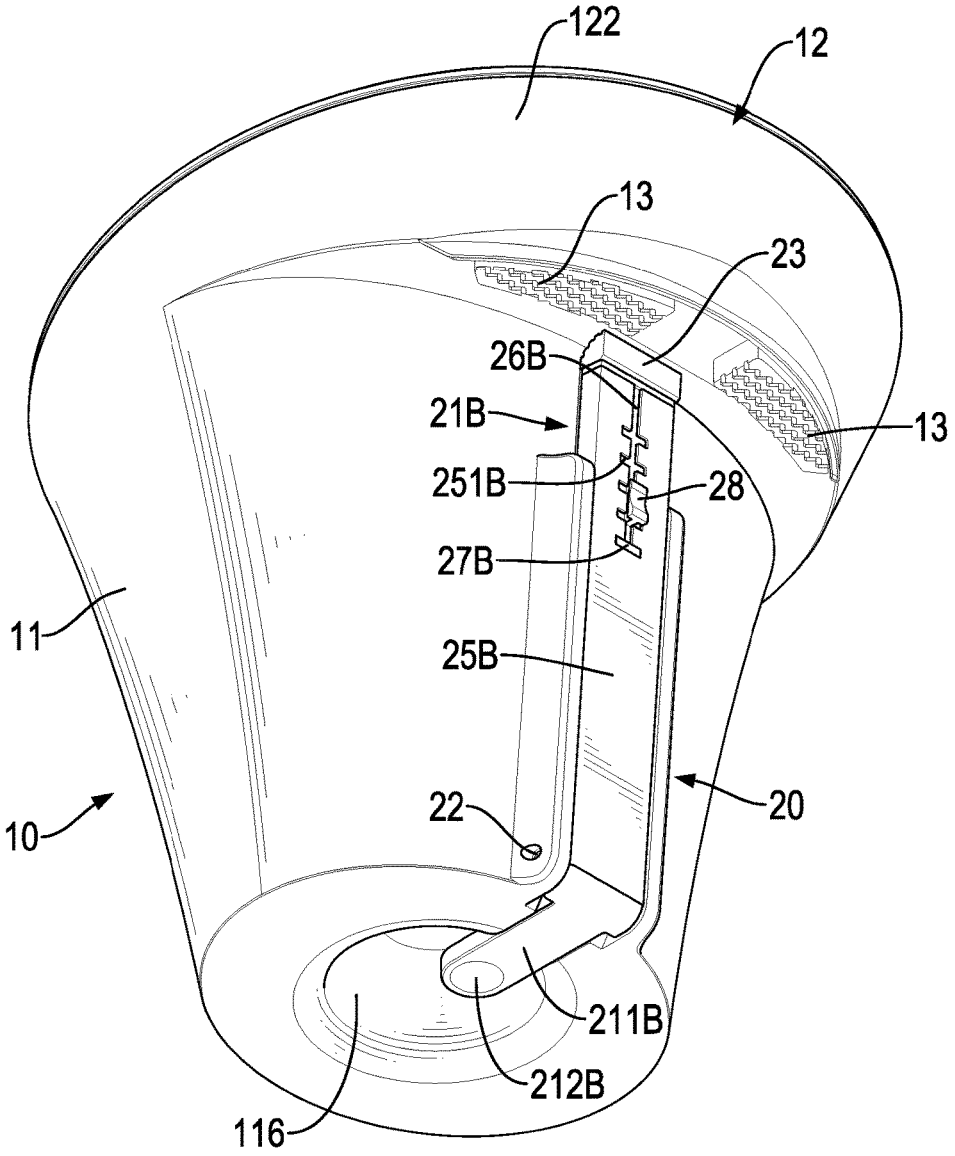
FIG. 10 is another perspective view of the storage bucket in FIG. 7.

The storage member 10 has a body 11, a holding portion 12, and two slip-proof elements 13. The body 11 has a top surface, an outer surface, a chamber 111, and an opening 112. The chamber 111 is formed in the body 11. The opening 112 is formed on the top surface of the body 11 and is in communication with the chamber 111 of the body 11. The holding portion 12 is formed on the outer surface of the body 11, is disposed adjacent to the opening 112 of the body 11, and has a bottom surface. The two slip-proof elements 13 are disposed on the bottom surface of the holding portion 12 at a spaced interval. Furthermore, the two slip-proof elements 13 are made of silica gel. With reference to FIGS. 2 and 10, shapes and sizes of the two slip-proof elements 13 may be adjusted on demands.

Figure 4:
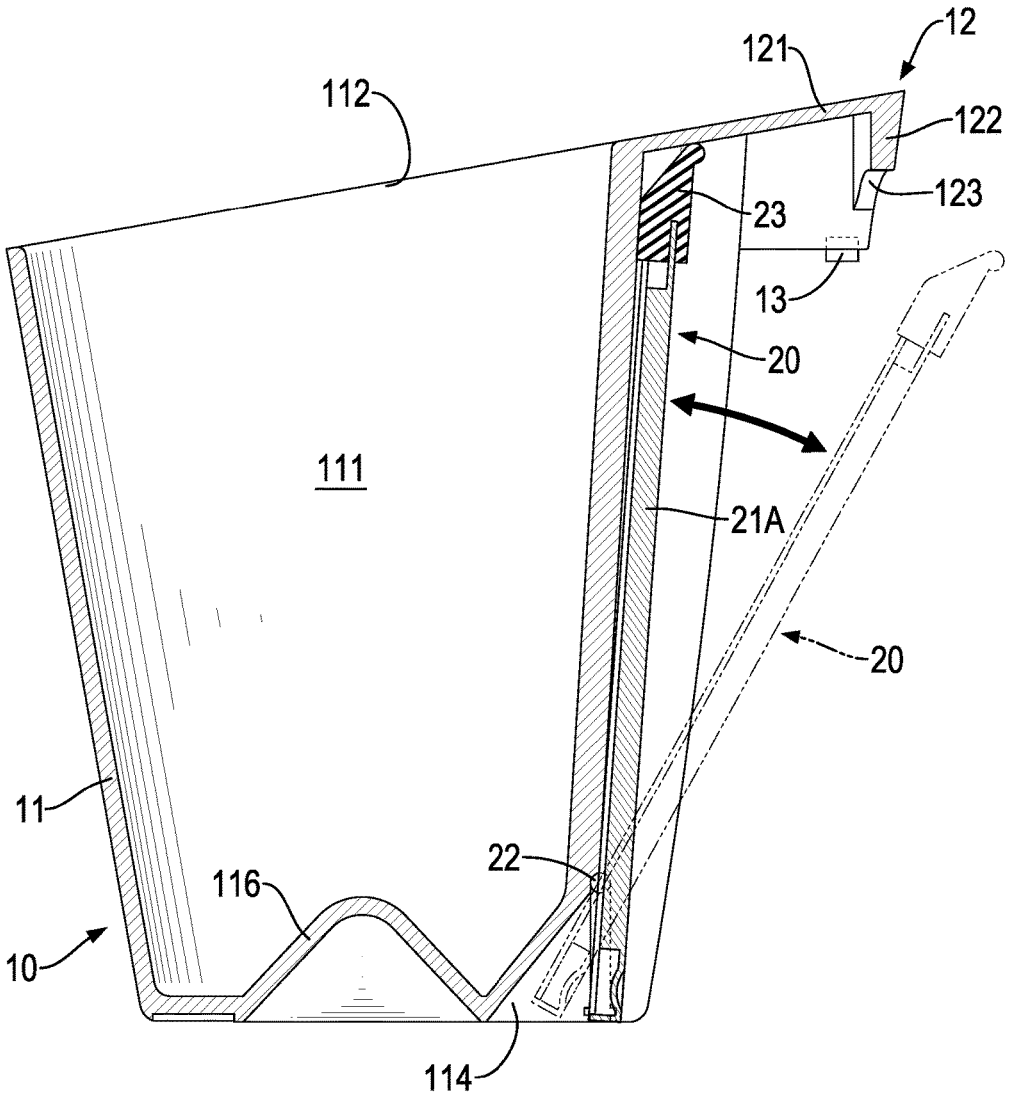
FIG. 4 is a side view in partial section of the storage bucket in FIG. 2.

With reference to FIGS. 2 to 4, the body 11 has a storage groove 113, a space 114, and two positioning slots 115. The storage groove 113 is formed on the outer surface of the body 11 and is below the holding portion 12. The space 114 is formed on the outer surface of the body 11. The space 114 is formed on the outer surface of the body 11 below the storage groove 113. The two positioning slots 115 are formed on the outer surface of the body 11 at a spaced interval and are located beside the space 114. The body 11 further has an inner bottom surface, a protrusion 116, and two positioning pins 117. The inner bottom surface of the body 11 is formed in the body 11. The protrusion 116 is formed on the inner bottom surface of the body 11 and is inserted into the chamber 111 of the body 11. The two positioning pins 117 are respectively inserted into the two positioning slots 115 and are respectively disposed on the body 11.

With reference to FIGS. 2 to 4, the holding portion 12 has an extending plate 121 and a connecting plate 122. The extending plate 121 is formed on the outer surface of the body 11, is disposed adjacent to the opening 112 of the body 11, and is located above the storage groove 113. The connecting plate 122 is formed on a bottom surface of the extending plate 121 and has a notch 123. The notch 123 is formed on a bottom surface of the connecting plate 122. The two slip-proof elements 13 are disposed on the bottom surface of the connecting plate 122 and are located at two sides of the notch 123.

Figure 8:
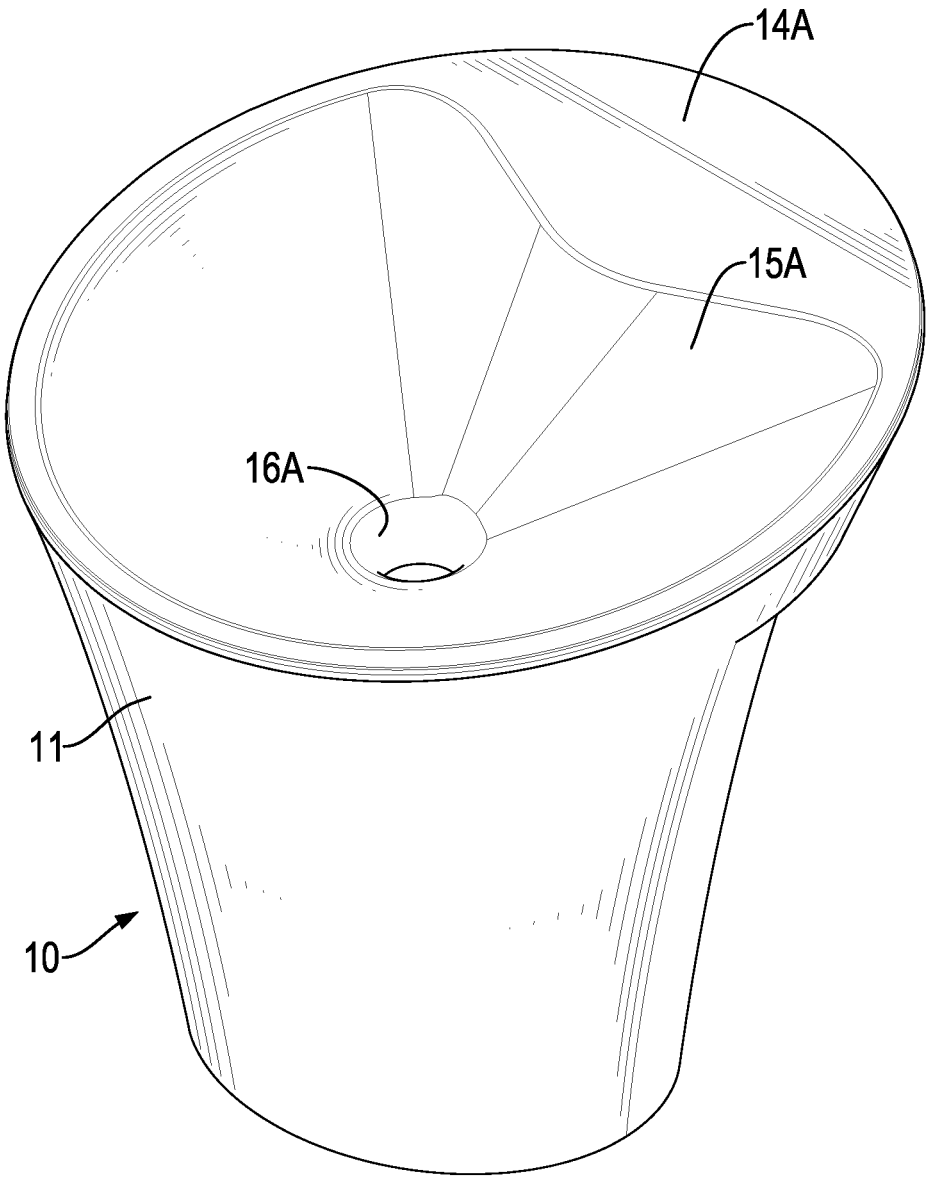
FIG. 8 is a perspective view of the storage bucket in FIG. 7, showing a cover is assembled on a body of the storage bucket.
Figure 9:
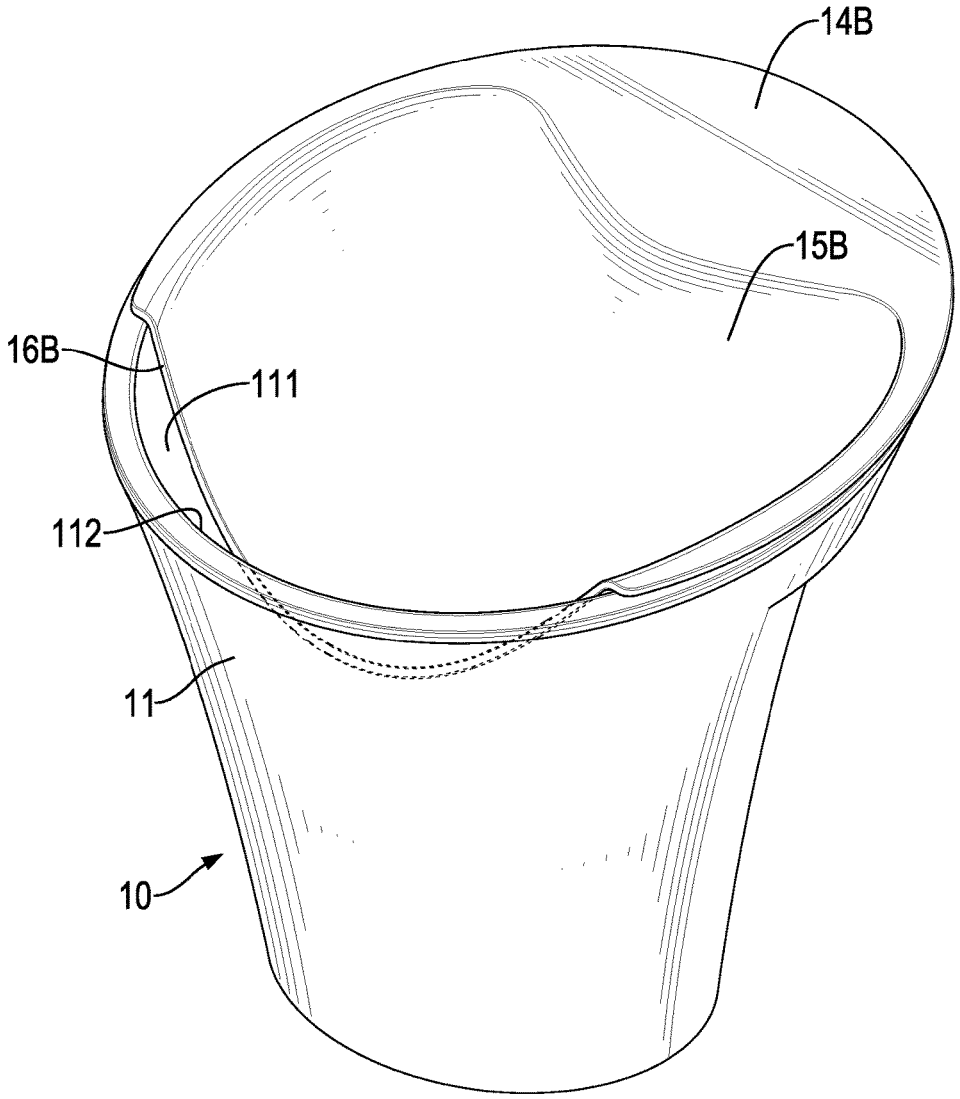
FIG. 9 is a perspective view of the storage bucket in FIG. 7, showing another cover is assembled on the body.

With reference to FIGS. 1, 8, and 9, the storage member 10 has a cover 14A, 14B. The cover 14A, 14B covers the opening 112 of the body 11 and has an inclined part 15A, 15B and a through hole 16A, 16B. The inclined part 15A, 15B extends toward the chamber 111 of the body 11. The through hole 16A, 16B is formed through the inclined part 15A, 15B and is in communication with the chamber 111 of the body 11.

With reference to FIGS. 1 to 3, in the first embodiment of the storage bucket, the supporting assembly 20 is pivotally disposed on the storage member 10. The supporting assembly 20 has a supporting rod 21A, two shafts 22, and a slip-proof foot 23. The supporting rod 21A is disposed on the body 11 and has two sides and a top end. The two shafts 22 are respectively and fixedly disposed on the two sides of the supporting rod 21A. The two shafts 22 are rotatably inserted into the two positioning slots 115 of the body 11 and are respectively positioned by the two positioning pins 117. The slip-proof foot 23 is disposed on the top end of the supporting rod 21A. The two shafts 22 can be selectively disposed on a middle section of the supporting rod 21A or a bottom section of the supporting rod 21A. The supporting assembly 20 has multiple reinforcing ribs 24. The reinforcing ribs 24 are intersected and disposed on the supporting rod 21A. The slip-proof foot 23 is made of silica gel. The slip-proof foot 23 is detachably disposed on the supporting rod 21A, or formed on the top end of the supporting rod 21A by injection over-molding. In addition, the supporting rod 21A is made of metal and is made by punching or extruding.

Figure 11:
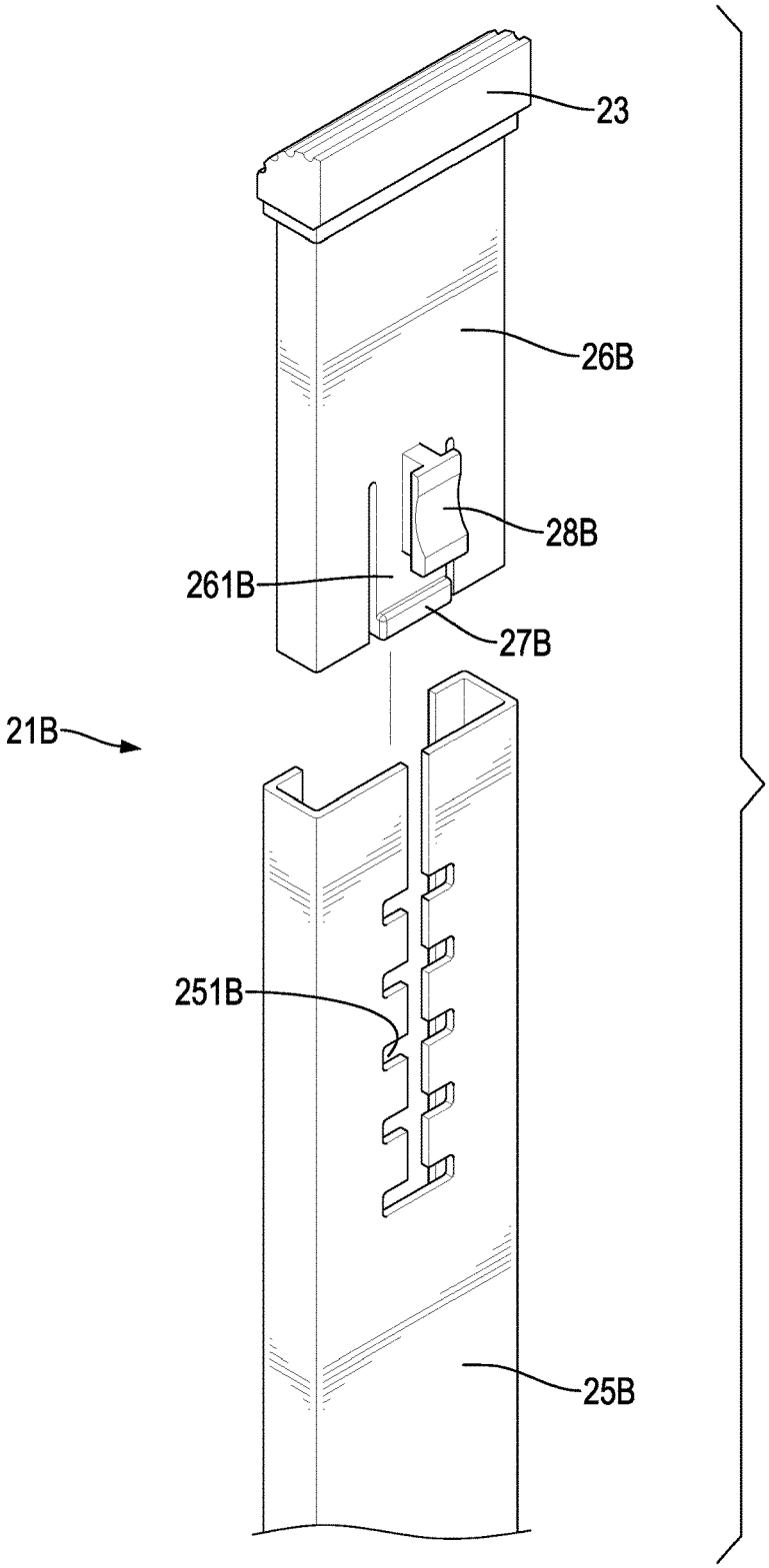
FIG. 11 is an enlarged and exploded perspective view in partial section of the storage bucket in FIG. 7.

With reference to FIGS. 9 to 11, in the second embodiment of the storage bucket, the supporting assembly 20 is pivotally disposed on the storage member 10. The supporting assembly 20 has a supporting rod 21B, two shafts 22, and a slip-proof foot 23. The supporting rod 21B is disposed on the body 11 and has a shell 25B, a retractable element 26B, and an engaging portion 27B. The shell 25B is disposed on the body 11 and has at least one engaging hole 251B formed through the shell 25B. The retractable element 26B is slidably disposed in the shell 25B. The retractable element 26B has an elastic sheet 261B formed on the retractable element 26B. The engaging portion 27B is disposed on the elastic sheet 261B of the retractable element 26B for fixing a relative position between the retractable element 26B and the shell 25B. The engaging portion 27B can be inserted into the at least one engaging hole 251B. The two shafts 22 are disposed on two sides of the shell 25B and are rotatably inserted into the two positioning slots 115 of the body 11. The slip-proof foot 23 is disposed on a top end of the retractable element 26B of the supporting rod 21B.

With reference to FIGS. 10 and 11, the supporting assembly 20 has a transverse rod 211B. The transverse rod 211B is disposed on a bottom end of the supporting rod 21B and extends below the protrusion 116. The transverse rod 211B has a pressing portion 212B formed on a bottom surface of the transverse rod 211B. Users can press the pressing portion 212B, and the supporting rod 21B can be rotated out of the body 11. The two shafts 22 are close to the bottom end of the supporting rod 21B. The supporting rod 21B has a pressing element 28. The pressing element 28 is disposed on the elastic sheet 261B above the engaging portion 27B. The engaging portion 27B is controlled by the pressing element 28 to be inserted into or released from the at least one engaging hole 251B. A cross section of the supporting rod 21B may be square, rectangular, circular, triangular, trapezoid, or irregular in shape. The slip-proof foot 23 is detachably disposed on the supporting rod 21B, or is formed on the top end of the supporting rod 21B by injection over-molding.

Figure 12:
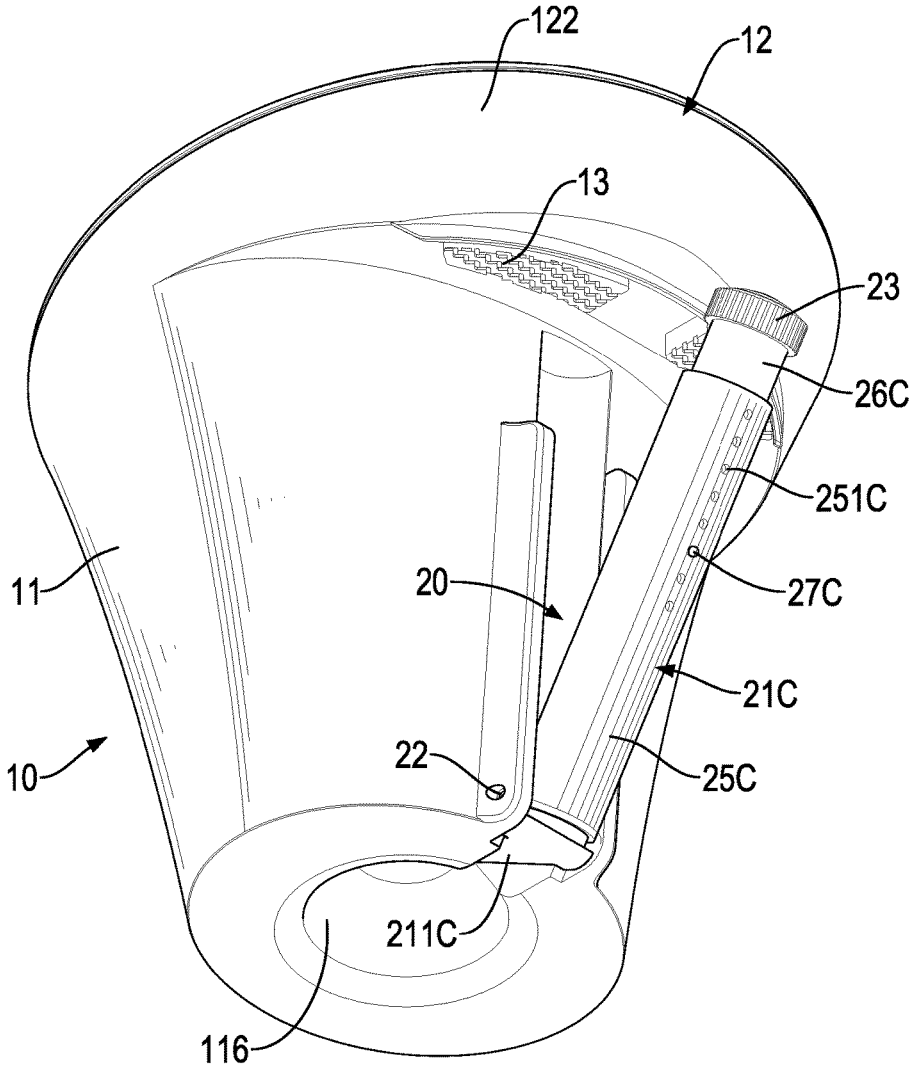
FIG. 12 is a perspective view of a third embodiment of a storage bucket in accordance with the present invention.

With reference to FIG. 12, in the third embodiment of the storage bucket, the supporting assembly 20 is rotatably disposed on the storage member 10. The supporting assembly 20 has a supporting rod 21C, two shafts 22, and a slip-proof foot 23. The supporting rod 21C is disposed on the body 11 and has a shell 25C, a retractable element 26C, and an engaging portion 27C. The shell 25C is disposed on the body 11 and has multiple engaging holes 251C formed through the shell 25C at spaced intervals. The retractable element 26C is slidably disposed in the shell 25C. The engaging portion 27C is disposed on the retractable element 26C for fixing a relative position between the retractable element 26C and the shell 25C. The engaging portion 27C can be inserted into one of the engaging holes 251C. The two shafts 22 are rotatably disposed on the body 11. The slip-proof foot 23 is disposed on the top end of the retractable element 26C of the supporting rod 21C. A cross section of the supporting rod 21C is circular in shape. The two shafts 22 are selectively disposed on a middle section of the supporting rod 21C or a bottom section of the supporting rod 21C. The slip-proof foot 23 is detachably disposed on the supporting rod 21C, or is formed on the top end of the supporting rod 21C by injection over-molding. The supporting assembly 20 has a transverse rod 211C. The transverse rod 211C is disposed on a bottom end of the supporting rod 21C and extends below the protrusion 116. Users can press the transverse rod 211C, and the supporting rod 21C can be rotated out of the body 11.

Figure 13:
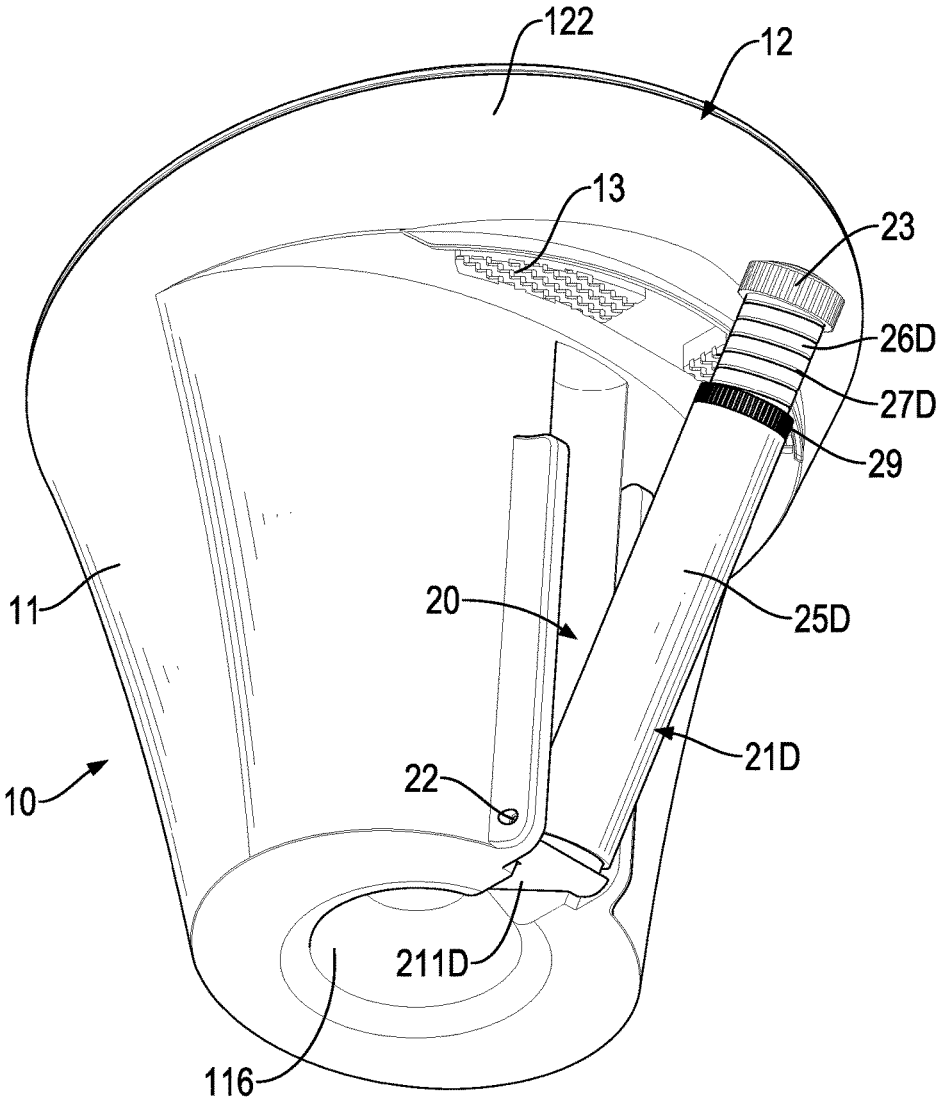
FIG. 13 is a perspective view of a fourth embodiment of a storage bucket in accordance with the present invention.

With reference to FIG. 13, in the fourth embodiment of the storage bucket, the supporting assembly 20 is pivotally disposed on the storage member 10. The supporting assembly 20 has a supporting rod 21D, two shafts 22, and a slip-proof foot 23. The supporting rod 21D is disposed on the body 11 and has a shell 25D, a retractable element 26D, an engaging portion 27D, and a positioning ring 29. The shell 25D is disposed on the body 11. The retractable element 26D is rotatably and slidably disposed in the shell 25D. The engaging portion 27D is a thread formed around the retractable element 26D. The positioning ring 29 is disposed on the engaging portion 27D and abuts the shell 25D for auxiliary fixing a relative position between the retractable element 26D and the shell 25D. The two shafts 22 are rotatably disposed on the body 11. The slip-proof foot 23 is disposed on the top end of the retractable element 26D of the supporting rod 21D. The two shafts 22 are selectively disposed on a middle section of the supporting rod 21D or a bottom section of the supporting rod 21D. The slip-proof foot 23 is detachably disposed on the supporting rod 21D, or is formed on the top end of the supporting rod 21D by injection over-molding. The supporting assembly 20 has a transverse rod 211D. The transverse rod 211D is disposed on a bottom end of the supporting rod 21D and extends below the protrusion 116. Users can press the transverse rod 211D, and the supporting rod 21D can be rotated out of the body 11.

With reference to FIGS. 3 and 4, the two shafts 22 of the supporting assembly 20 are inserted into the two positioning slots 115. The two positioning pins 117 are inserted into the two positioning slots 115 for fixing the two shafts 22, respectively. The supporting rod 21 is rotated along the two shafts 22. When the supporting rod 21 is not in use, the supporting rod 21 is rotated into the storage groove 113. When the supporting rod 21 is in use, the supporting rod 21 is rotated out of the storage groove 113, and the bottom end of the supporting rod 21 is inserted into the space 114 of the body 11. When the bottom end of the supporting rod 21 abuts the body 11, a rotated angle of the supporting rod 21 is the maximum. The reinforcing ribs 21 are intersected and disposed on the supporting rod 21 for increasing the strength of the supporting rod 21. In addition, to store multiple storage buckets, the storage buckets can be stacked upwardly to save a storage space.

Figure 5:
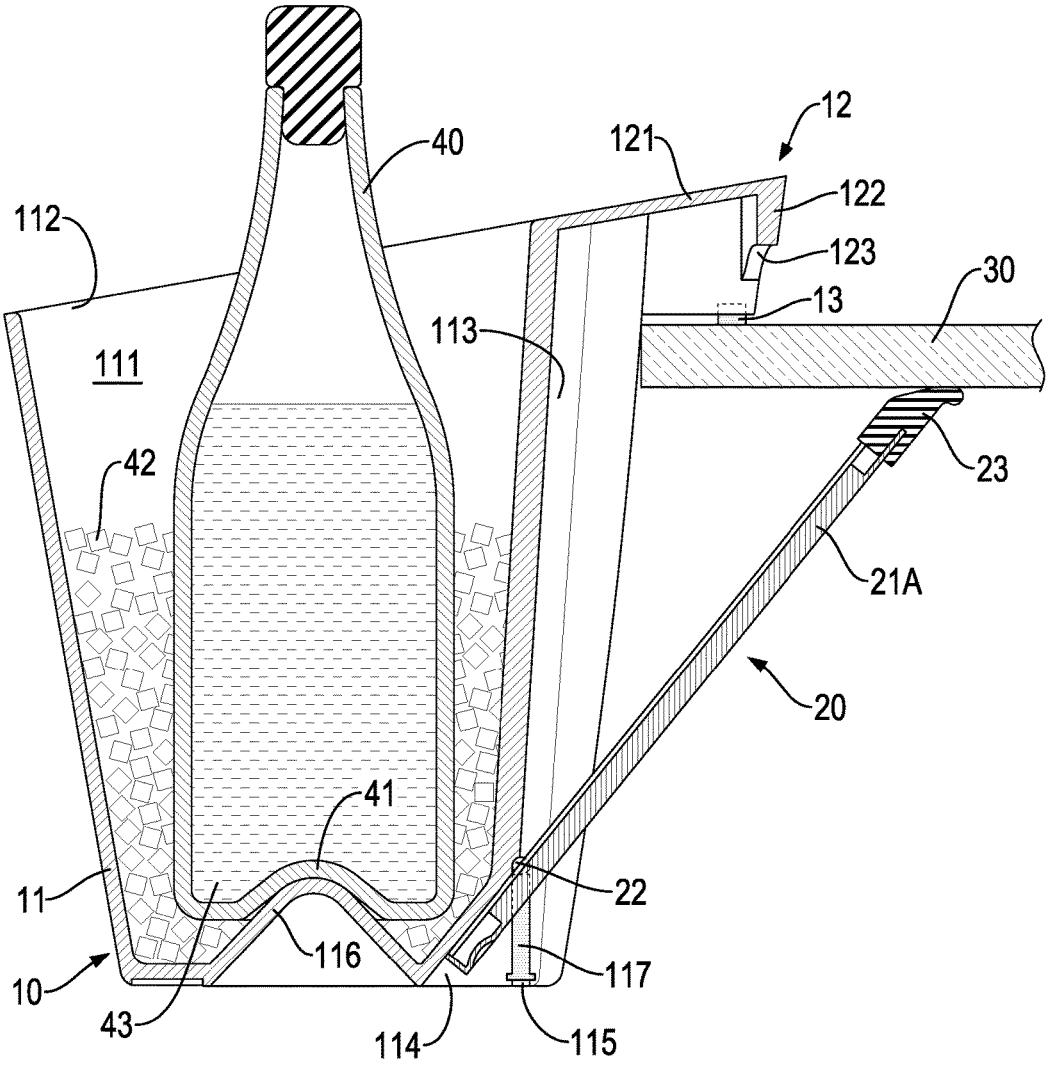
FIG. 5 is an operational side view in partial section of the storage bucket in FIG. 4.

With reference to FIG. 5, to dispose the storage bucket beside an edge of a table 30, the supporting rod 21A can be rotated outwardly. The storage bucket is moved toward the edge of the table 30. The body 11 abuts the edge of the table 30. The two slip-proof elements 13 press against a top surface of the table 30. The supporting rod 21A can be rotated toward the body 11, and the slip-proof foot 23 abuts against a bottom surface of the table 30. When an object is put into the chamber 111 of the storage bucket, a counterclockwise torque is generated by the object, and a clockwise torque is generated by the slip-proof foot 23 on the supporting rod 21. The counterclockwise torque is offset by the clockwise torque. The storage bucket can be steadily disposed beside the edge of the table 30.

Figure 6:
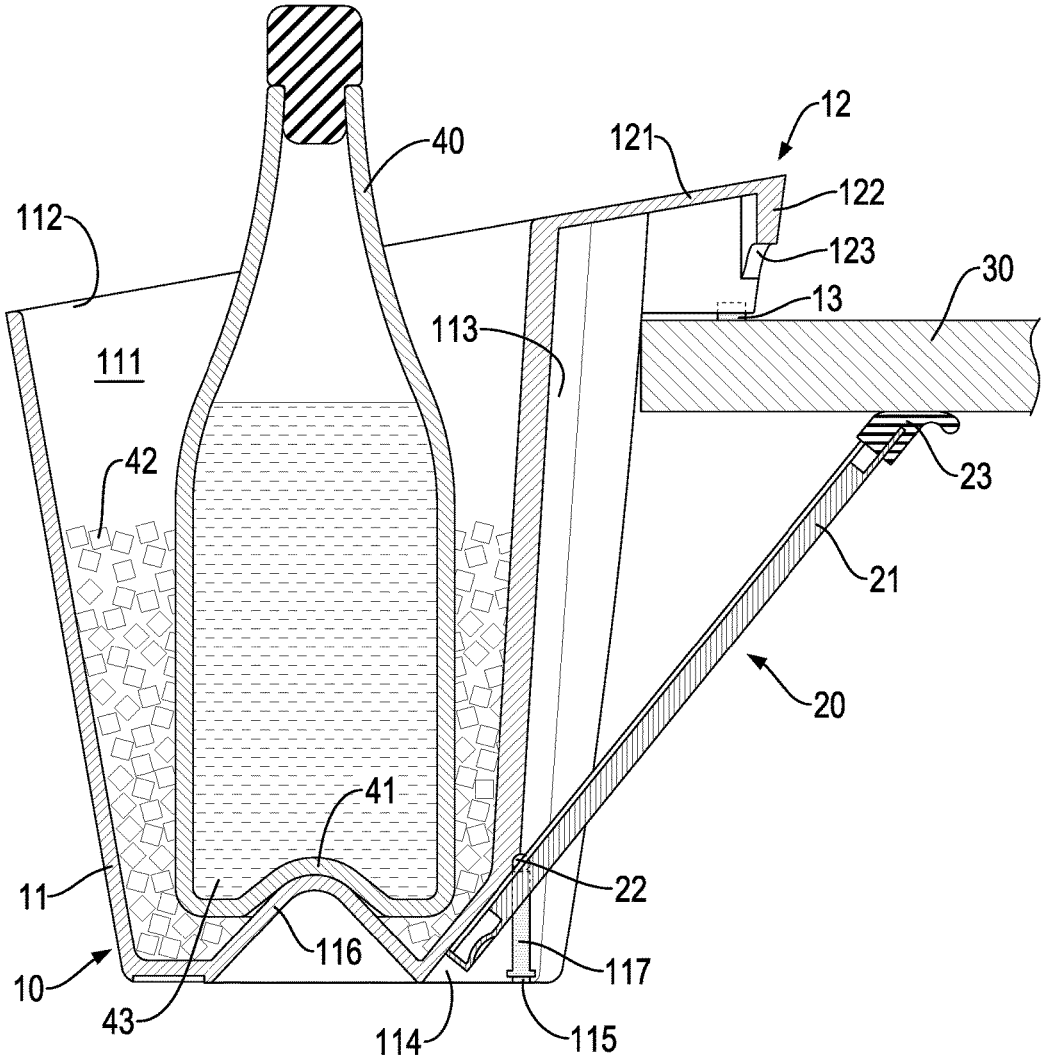
FIG. 6 is another operational side view in partial section of the storage bucket in FIG. 4.

With reference to FIGS. 5 and 6, the slip-proof foot 23 is made of silica gel and has a good deformation elasticity. When the slip-proof foot 23 abuts the bottom surface of the table 30, the angle formed between the supporting rod 21 and the bottom surface of the table 30 can be adjusted by the slip-proof foot 23 for increasing a slip-proof effect. Furthermore, the supporting rod 21 can be rotated to adjust an angle of the supporting rod 21. The storage bucket can be applied to many tables 30 of different thicknesses. The two slip-proof elements 13 are made of silica gel. The two slip-proof elements 13 and the slip-proof foot 23 all have good deformation elasticity to increase an allowable thickness range for disposing the storage bucket beside the table 30.

Figure 14:
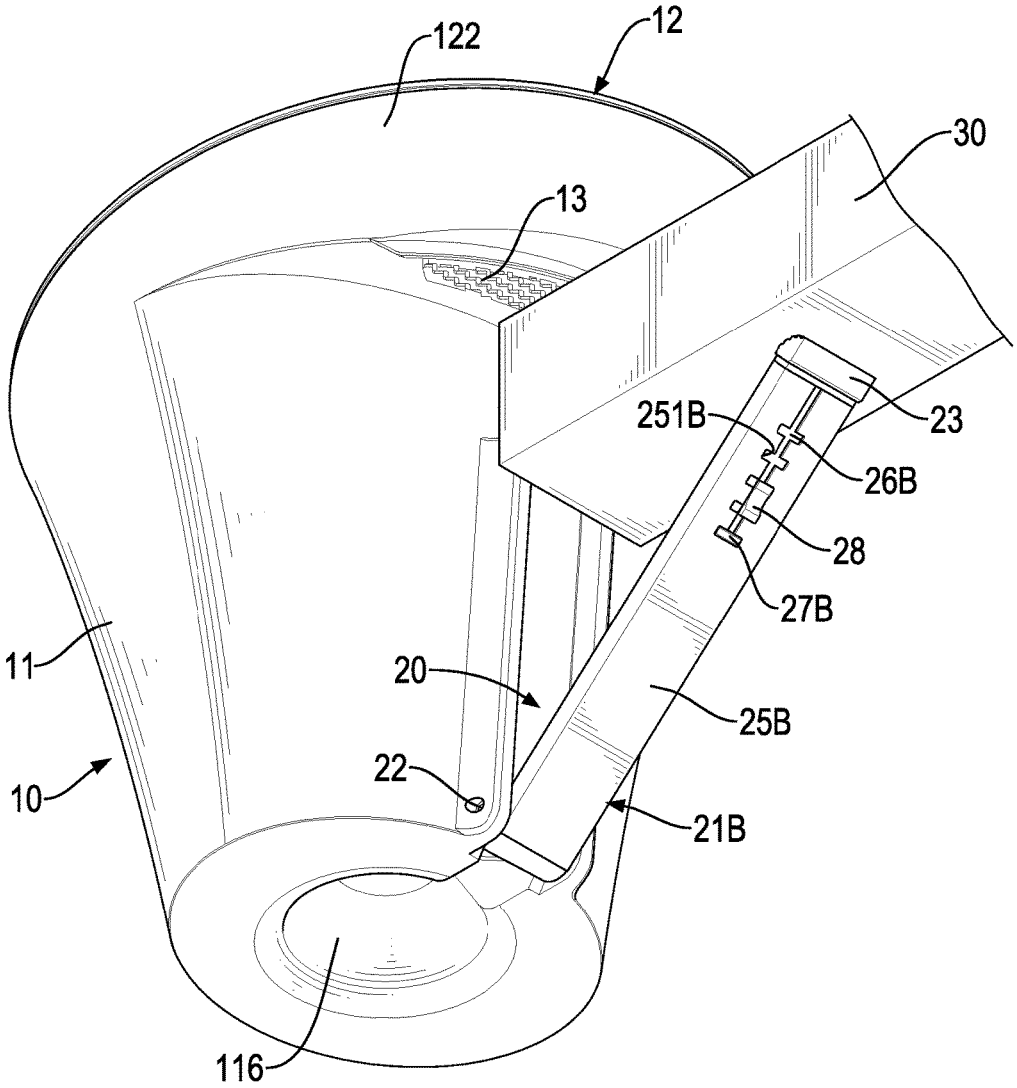
FIG. 14 is an operational perspective view in partial section of the storage bucket in FIG. 10.
Figure 15:
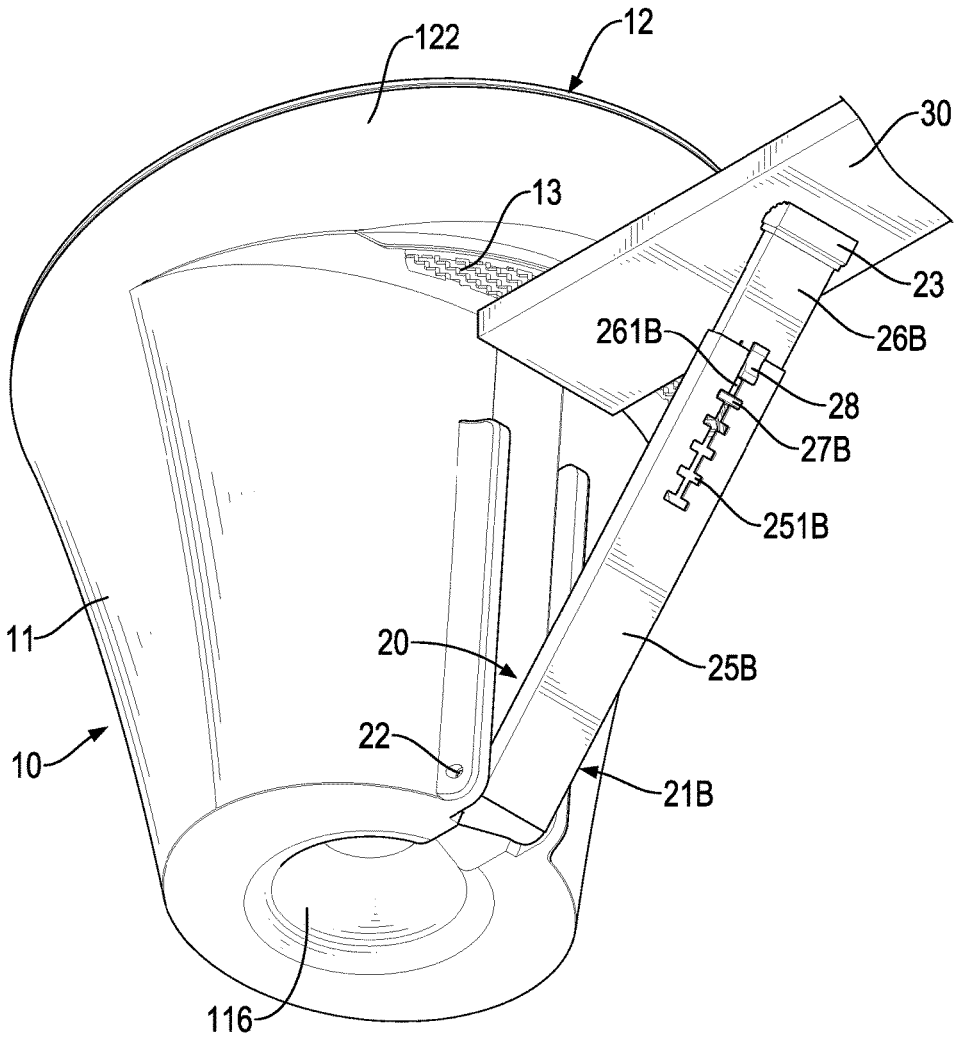
FIG. 15 is another operational perspective view in partial section of the storage bucket in FIG. 10.

With reference to FIGS. 14 and 15, the elastic sheet 261B is pressed by users via the pressing element 28. The engaging portion 27B is detached from the at least one engaging hole 251B by the elastic sheet 261B to release the positioning relation between the shell 25B and the retractable element 26B. The retractable element 26B can be slid relative to the shell 25B. When the retractable element 26B is slid to a desired position, the pressing element 28 can be released, and the engaging portion 27B is inserted into one of the at least one engaging hole 251B for fixing the retractable element 26B on the shell 25B. The retractable element 26B is slid in the shell 25B for adjusting the length of the supporting rod 21B and increasing the allowable thickness range of the table 30. The relative position between the shell 25B and the retractable element 26B is adjusted by the supporting rod 21B for adjusting a structural connection among the slip-proof foot 23, the two slip-proof elements 13, and the table 30.

With reference to FIGS. 5 and 6, the storage bucket can be an ice bucket. A wine bottle 40 is put into the chamber 111 of the body 11 in the storage bucket. A bottom surface of the wine bottle 40 is put on the protrusion 116 of the body 11, and the protrusion 116 is inserted into a recess 41 formed on the bottom surface of the wine bottle 40 for positioning the wine bottle 40. The wine bottle 40 stands in the body 11 uprightly and steadily. Ice cubes 42 are put into the chamber 111 of the body 11 around the wine bottle 40 for cooling the wine bottle 40. The mouthfeel of wine 43 in the wine bottle 40 is cool evenly. Furthermore, the holding portion 12 can be grasped by the users. One hand of the user is inserted through the notch 123 for grasping the extending plate 121. Moreover, information of the wine bottle 40 can be displayed on the extending plate 121.

Figure 7:
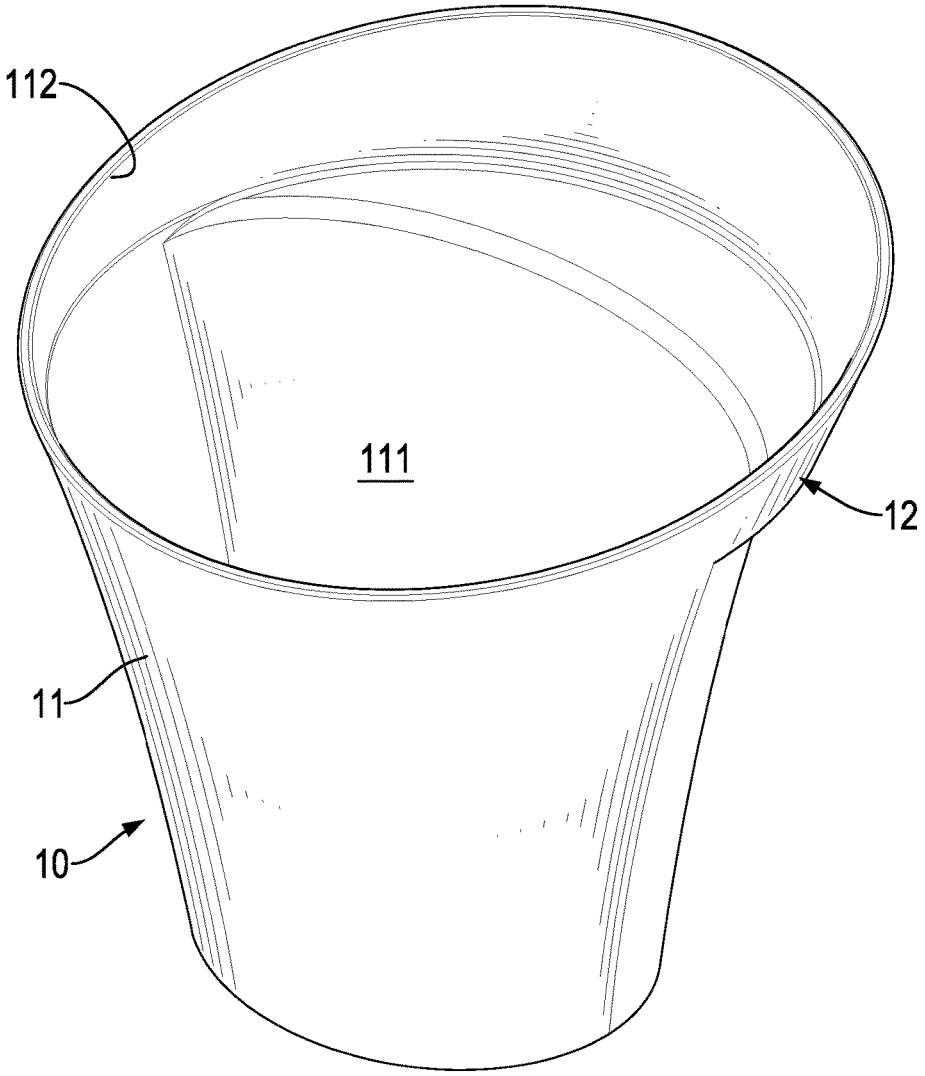
FIG. 7 is a perspective view of a second embodiment of a storage bucket in accordance with the present invention.

With reference to FIGS. 1, 7, and 8, the storage member 10 can be a wine tasting spittoon. The cover 14A, 14B covers the opening 112 of the storage member 10 for enhancing the aesthetic appeal of the wine tasting spittoon. In tasting, wine or water after gargling can flow along the inclined part 15A, 15B, and then flow into the chamber 111 via the through hole 16A, 16B. The scent of wine and water after gargling can be covered by the cover 14A, 14B.

Accordingly, the storage bucket can be disposed beside the edge of the table 30 by the slip-proof elements 13 on the body 11 and the slip-proof foot 23 on the supporting rod 21A, 21B, 21C, 21D. The storage bucket occupies very little space above the table-top surface. The storage bucket is located beside the table 30 for convenience in retrieving the object from the storage bucket. The length of the supporting rod 21B, 21C, 21D can be adjusted according to the thickness of the table 30. Shapes and sizes of the two slip-proof elements 13 and the slip-proof foot 23 may be adjusted on demand. In addition, the wine bottle 40 stands in the body 11 uprightly and steadily by the protrusion 116. The wine bottle 40 can be evenly cooled by the ice cubes 42. The mouthfeel of wine 43 in the wine bottle 40 is cool.

What is claimed is:

1. A storage bucket comprising:
a storage member having
a body having
a top surface;
an outer surface;
a chamber formed in the body; and
an opening formed on the top surface of the body and is in communication with the chamber of the body;
a holding portion formed on the outer surface of the body, disposed adjacent to the opening of the body, and having a bottom surface; and
two slip-proof elements disposed on the bottom surface of the holding portion; and
a supporting assembly pivotally disposed on the storage member and having
a supporting rod disposed on the body and having two sides and a top end;
two shafts respectively and fixedly disposed on the two sides of the supporting rod, and rotatably inserted into the body; and
a slip-proof foot disposed on the top end of the supporting rod.

2. The storage bucket as claimed in claim 1, wherein the storage member has a cover, the cover covers the opening of the body and has an inclined part and a through hole, the inclined part extends toward the chamber of the body, and the through hole is formed through the inclined part and is in communication with the chamber of the body.

3. The storage bucket as claimed in claim 1, wherein the body has
a storage groove formed on the outer surface of the body and being below the holding portion;
a space formed on the outer surface of the body below the storage groove;
two positioning slots formed on the outer surface of the body at a spaced interval and located beside the space;
an inner bottom surface formed in the body;
a protrusion formed on the inner bottom surface of the body and inserted into the chamber of the body; and
two positioning pins respectively inserted into the two positioning slots and disposed on the body.

4. The storage bucket as claimed in claim 3, wherein the storage member has a cover, the cover covers the opening of the body and has an inclined part and a through hole, the inclined part extends toward the chamber of the body, and the through hole is formed through the inclined part and is in communication with the chamber of the body.

5. The storage bucket as claimed in claim 1, wherein the supporting assembly has multiple reinforcing ribs, and the reinforcing ribs are intersected and disposed on the supporting rod.

6. The storage bucket as claimed in claim 5, wherein the storage member has a cover, the cover covers the opening of the body and has an inclined part and a through hole, the inclined part extends toward the chamber of the body, and the through hole is formed through the inclined part and is in communication with the chamber of the body.

7. The storage bucket as claimed in claim 5, wherein the body has
a storage groove formed on the outer surface of the body and being below the holding portion;
a space formed on the outer surface of the body below the storage groove;
two positioning slots formed on the outer surface of the body at a spaced interval and located beside the space;
an inner bottom surface formed in the body;
a protrusion formed on the inner bottom surface of the body and inserted into the chamber of the body; and
two positioning pins respectively inserted into the two positioning slots and disposed on the body.

8. The storage bucket as claimed in claim 7, wherein the storage member has a cover, the cover covers the opening of the body and has an inclined part and a through hole, the inclined part extends toward the chamber of the body, and the through hole is formed through the inclined part and is in communication with the chamber of the body.

9. The storage bucket as claimed in claim 1, wherein the supporting rod has
a shell disposed on the body;
a retractable element slidably disposed in the shell; and
an engaging portion disposed on the retractable element for fixing a relative position between the retractable element and the shell.

10. The storage bucket as claimed in claim 9, wherein the storage member has a cover, the cover covers the opening of the body and has an inclined part and a through hole, the inclined part extends toward the chamber of the body, and the through hole is formed through the inclined part and is in communication with the chamber of the body.

11. The storage bucket as claimed in claim 9, wherein the body has
a storage groove formed on the outer surface of the body and being below the holding portion;
a space formed on the outer surface of the body below the storage groove;
two positioning slots formed on the outer surface of the body at a spaced interval and located beside the space;
an inner bottom surface formed in the body;
a protrusion formed on the inner bottom surface of the body and inserted into the chamber of the body; and
two positioning pins respectively inserted into the two positioning slots and disposed on the body.

12. The storage bucket as claimed in claim 11, wherein the storage member has a cover, the cover covers the opening of the body and has an inclined part and a through hole, the inclined part extends toward the chamber of the body, and the through hole is formed through the inclined part and is in communication with the chamber of the body.

13. The storage bucket as claimed in claim 9, wherein
the shell has
at least one engaging hole formed through the shell;
the retractable element has
an elastic sheet formed on the retractable element, wherein the engaging portion is disposed on the elastic sheet, and the engaging portion can be inserted into the at least one engaging hole for fixing the relative position between the retractable element and the shell; and
the supporting rod has
a pressing element disposed on the elastic sheet above the engaging portion, wherein the engaging portion is controlled by the pressing element to be inserted into or released from the at least one engaging hole.

14. The storage bucket as claimed in claim 13, wherein the storage member has a cover, the cover covers the opening of the body and has an inclined part and a through hole, the inclined part extends toward the chamber of the body, and the through hole is formed through the inclined part and is in communication with the chamber of the body.

15. The storage bucket as claimed in claim 13, wherein the body has a storage groove formed on the outer surface of the body and being below the holding portion;

a space formed on the outer surface of the body below the storage groove;

two positioning slots formed on the outer surface of the body at a spaced interval and located beside the space;

an inner bottom surface formed in the body;

a protrusion formed on the inner bottom surface of the body and inserted into the chamber of the body; and two positioning pins respectively inserted into the two positioning slots and disposed on the body.

16. The storage bucket as claimed in claim 15, wherein the storage member has a cover, the cover covers the opening of the body and has an inclined part and a through hole, the inclined part extends toward the chamber of the body, and the through hole is formed through the inclined part and is in communication with the chamber of the body.

17. The storage bucket as claimed in claim 9, wherein the shell has multiple engaging holes, the engaging holes are formed through the shell at spaced intervals, and the engaging portion is inserted into one of the engaging holes selectively.

18. The storage bucket as claimed in claim 17, wherein the storage member has a cover, the cover covers the opening of the body and has an inclined part and a through hole, the inclined part extends toward the chamber of the body, and the through hole is formed through the inclined part and is in communication with the chamber of the body.

19. The storage bucket as claimed in claim 17, wherein the body has a storage groove formed on the outer surface of the body and being below the holding portion;

a space formed on the outer surface of the body below the storage groove;

two positioning slots formed on the outer surface of the body at a spaced interval and located beside the space;

an inner bottom surface formed in the body;

a protrusion formed on the inner bottom surface of the body and inserted into the chamber of the body; and two positioning pins respectively inserted into the two positioning slots and disposed on the body.

20. The storage bucket as claimed in claim 19, wherein the storage member has a cover, the cover covers the opening of the body and has an inclined part and a through hole, the inclined part extends toward the chamber of the body, and the through hole is formed through the inclined part and is in communication with the chamber of the body.

21. The storage bucket as claimed in claim 9, wherein the engaging portion is a thread, is disposed around the retractable element, and engages with the shell, and the supporting rod has a positioning ring disposed on the engaging portion and abutting the shell.

22. The storage bucket as claimed in claim 21, wherein the storage member has a cover, the cover covers the opening of the body and has an inclined part and a through hole, the inclined part extends toward the chamber of the body, and the through hole is formed through the inclined part and is in communication with the chamber of the body.

23. The storage bucket as claimed in claim 21, wherein the body has a storage groove formed on the outer surface of the body and being below the holding portion;

a space formed on the outer surface of the body below the storage groove;

two positioning slots formed on the outer surface of the body at a spaced interval and located beside the space;

an inner bottom surface formed in the body;

a protrusion formed on the inner bottom surface of the body and inserted into the chamber of the body; and two positioning pins respectively inserted into the two positioning slots and disposed on the body.

24. The storage bucket as claimed in claim 23, wherein the storage member has a cover, the cover covers the opening of the body and has an inclined part and a through hole, the inclined part extends toward the chamber of the body, and the through hole is formed through the inclined part and is in communication with the chamber of the body.

* * * * *